US010208905B2

(12) United States Patent
Lavin et al.

(10) Patent No.: US 10,208,905 B2
(45) Date of Patent: Feb. 19, 2019

(54) RECESSED LIGHT FIXTURES FOR EFFICIENTLY PROVIDING AESTHETICALLY PLEASING INDIRECT LIGHTING

(71) Applicant: GENERATION BRANDS LLC, Skokie, IL (US)

(72) Inventors: Sean Lavin, Winnetka, IL (US); James Gerard Ungaro, Chicago, IL (US)

(73) Assignee: GENERATION BRANDS LLC, Skokie, IL (US)

( * ) Notice: Subject to any disclaimer, the term of this patent is extended or adjusted under 35 U.S.C. 154(b) by 71 days.

(21) Appl. No.: 15/436,142

(22) Filed: Feb. 17, 2017

(65) Prior Publication Data

US 2018/0187844 A1 Jul. 5, 2018

Related U.S. Application Data

(60) Provisional application No. 62/442,842, filed on Jan. 5, 2017.

(51) Int. Cl.

| | |
|---|---|
| ***F21S 8/02*** | (2006.01) |
| ***F21V 7/09*** | (2006.01) |
| ***F21V 21/04*** | (2006.01) |
| ***F21V 7/06*** | (2006.01) |
| ***F21V 14/04*** | (2006.01) |

(Continued)

(52) U.S. Cl.

CPC ..... *F21S 8/026* (2013.01); *F21V 7/048* (2013.01); *F21V 7/06* (2013.01); *F21V 14/04* (2013.01); *F21V 21/04* (2013.01); *F21Y 2105/18* (2016.08); *F21Y 2115/10* (2016.08)

(58) Field of Classification Search

CPC .. F21S 8/026; F21V 7/048; F21V 7/06; F21V 14/04; F21V 21/04; F21V 21/044; F21V 21/045; F21Y 2105/18

See application file for complete search history.

(56) References Cited

U.S. PATENT DOCUMENTS

2007/0263393 A1* 11/2007 Van De Ven ..... F21V 29/2212 362/362
2011/0080741 A1* 4/2011 Noh ..... F21S 8/026 362/294

(Continued)

OTHER PUBLICATIONS

Atelier Sedap/Lighting, http://www.sedap.com/lighting/fr/produits/793, retrieved Dec. 7, 2016.

(Continued)

*Primary Examiner* — Alan B Cariaso

(74) *Attorney, Agent, or Firm* — Marshall, Gerstein & Borun LLP

(57) ABSTRACT

A recessed light fixture configured to deliver indirect light to an area. The recessed light fixture includes a trim component, a reflector coupled to the trim component, and an annular ring including a plurality of light-emitting diodes (LEDs). The trim component has an outer wall and an inner wall spaced radially inward of the outer wall, and defines an annular recess between the outer and inner walls. The reflector includes a patterned reflective surface. The annular ring is arranged within the annular recess of the trim component. The LEDs are configured to emit light toward the reflector so that the reflector redirects the light to deliver the indirect light to the area.

16 Claims, 9 Drawing Sheets

(51) Int. Cl.

| | |
|---|---|
| ***F21V 7/04*** | (2006.01) |
| *F21Y 105/18* | (2016.01) |
| *F21Y 115/10* | (2016.01) |

(56) References Cited

U.S. PATENT DOCUMENTS

| | | | | |
|---|---|---|---|---|
| 2013/0322091 | A1* | 12/2013 | Honeycutt | F21S 8/026 362/319 |
| 2013/0322093 | A1* | 12/2013 | Ono | F16B 2/248 362/341 |
| 2014/0056026 | A1* | 2/2014 | Boomgaarden | F21S 8/026 362/609 |
| 2014/0071687 | A1* | 3/2014 | Tickner | F21V 21/03 362/294 |
| 2017/0082266 | A1 | 3/2017 | Ruhland et al. | |
| 2017/0138565 | A1* | 5/2017 | Ko | F21V 7/04 |

OTHER PUBLICATIONS

Zaneen, Barbalux System—Recessing Frame, http://www.zaneen.com/products/I3957000, retrieved Dec. 7, 2016.

Fabbian, Lighting Fixtures Modern Lights Lamps design Fabbian, http://www.fabbian.com/en/f19-tools, retrieved Dec. 7, 2016.

Majeax Lighting, Gypusm MH-2517, http://www.majeax.com/h-pd-302-0_35.html?skeyword=gypsum, retrieved Dec. 7, 2016.

Beaux-Arts Classic Products, 3 Inch Decorative Recessed Light Trim in Victorian Style, https://www.beaux-artsclassicproducts.com/product/3%e2%80%b3-victorian-style-recessed-light-trim-lr-131/, retrieved Dec. 7, 2016.

FLOS, Skygarden S Modern Pendant Light by Marcel Wanders, https://usa.flos.com/modern-pendant-lights/Skygarden, retrieved Dec. 7, 2016.

* cited by examiner

RECESSED LIGHT FIXTURES FOR EFFICIENTLY PROVIDING AESTHETICALLY PLEASING INDIRECT LIGHTING

FIELD OF DISCLOSURE

The present disclosure generally relates to light fixtures, and more particularly, recessed light fixtures that efficiently provide aesthetically pleasing indirect lighting.

BACKGROUND

Recessed lighting systems are commonly used indoors to provide the effect of light shining through a hole in a ceiling or wall. Recessed lighting systems generally include a light fixture installed in a ceiling or wall recess. Depending on the desired illumination scheme, the light fixture is typically configured to provide either direct lighting or indirect lighting.

Direct lighting involves casting light primarily in one direction to illuminate an individual object (e.g., a painting, a table, a kitchen counter, etc.) or limited portion of a room, or even for general illumination purposes. A can light is one example of a recessed lighting system incorporating a direct lighting light fixture. While direct lighting tends to be very efficient, it tends to create glare and shadows and therefore is typically not used for illuminating a large area or an entire room.

Indirect lighting, on the other hand, provides more diffuse lighting and is suitable for illuminating large areas. Indirect lighting involves bouncing light off a reflective surface, thereby redirecting and/or scattering the light to various portions of a room. While indirect lighting reduces glare and provides generally uniform luminance levels, it can be inefficient and uneconomical since at least some of the light is absorbed by the reflective surface. Moreover, because of its diffuse nature, indirect lighting is generally not suitable for spotlighting an individual object.

Some known sources of indirect lighting have been created with decorative patterns to enhance the architecture of a space. While such decorative patterns do not affect the aesthetic value of the provided indirect lighting, they do affect the efficiency of the indirect lighting, thereby further exacerbating the inefficiency of indirect lighting.

The present disclosure sets forth various recessed light fixtures embodying advantageous alternatives to existing recessed lighting systems and that may address one or more of the challenges or needs mentioned above.

SUMMARY

One aspect of the present disclosure provides a recessed light fixture configured to deliver indirect light to an area. The recessed light fixture includes a trim component, a reflector coupled to the trim component, and an annular ring including a plurality of light-emitting diodes (LEDs). The trim component has an outer wall and an inner wall spaced radially inward of the outer wall, and defines an annular recess between the outer and inner walls. The reflector includes a patterned reflective surface. The annular ring is arranged within the annular recess of the trim component. The LEDs are configured to emit light toward the reflector so that the reflector redirects the light to deliver the indirect light to the area.

Another aspect of the present disclosure provides a recessed light fixture configured to deliver indirect light to an area. The recessed light fixture includes a trim component, a dome-shaped reflector coupled to the trim component, and an annular ring including a plurality of light-emitting diodes (LEDs). The trim component has an outer wall and an inner wall spaced radially inward of the outer wall, and defines an annular recess between the outer and inner walls. The reflector includes a patterned reflective surface including a plurality of decorative features. The annular ring is arranged within the annular recess of the trim component. The LEDs are configured to emit light toward the reflector so that the reflector redirects the light to deliver the indirect light to the area.

Another aspect of the present disclosure provides a recessed light fixture configured to deliver indirect light to an area. The recessed light fixture includes a trim assembly, a reflector coupled to the trim assembly, and an annular ring including a plurality of light-emitting diodes (LEDs). The trim assembly includes an annular track member and a flanged portion. The annular track member has an outer wall and an inner wall spaced radially inward of the outer wall, and defines an annular recess between the outer and inner walls. The flanged portion is at least partially disposed in the annular recess. The reflector includes a patterned reflective surface including a plurality of decorative features. The annular ring is seated on the flanged portion within the annular recess of the trim component. The LEDs are configured to emit light toward the reflector so that the reflector redirects the light to deliver the indirect light to the area.

DETAILED DESCRIPTION

The present disclosure is generally directed to recessed light fixtures that provide indirect lighting. The recessed light fixtures generate the indirect lighting by including a plurality of light-emitting diodes (LEDs) that emit light rays toward a curved reflector, which in turn scatters and/or redirects the light rays to various portions of a room. The indirect lighting provided by the recessed light fixtures disclosed herein generally uniformly illuminates the room without glare. The recessed light fixtures disclosed herein are, however, also provided with decorative patterns that enhance the architecture of the room and are configured to illuminate or highlight these decorative patterns in a manner that does not reduce the lighting output or efficacy of the fixture. The recessed light fixtures described herein are thus able to efficiently provide aesthetically pleasing indirect lighting.

FIGS. 1-9 depict one example of a recessed light fixture 100 constructed in accordance with the principles of the present disclosure. The recessed light fixture 100 is configured to provide indirect light to an area in a manner that illuminates the area without glare and also highlights decorative elements in the light fixture 100 without significantly reducing the lighting output and efficacy of the light fixture 100.

Figure 5:
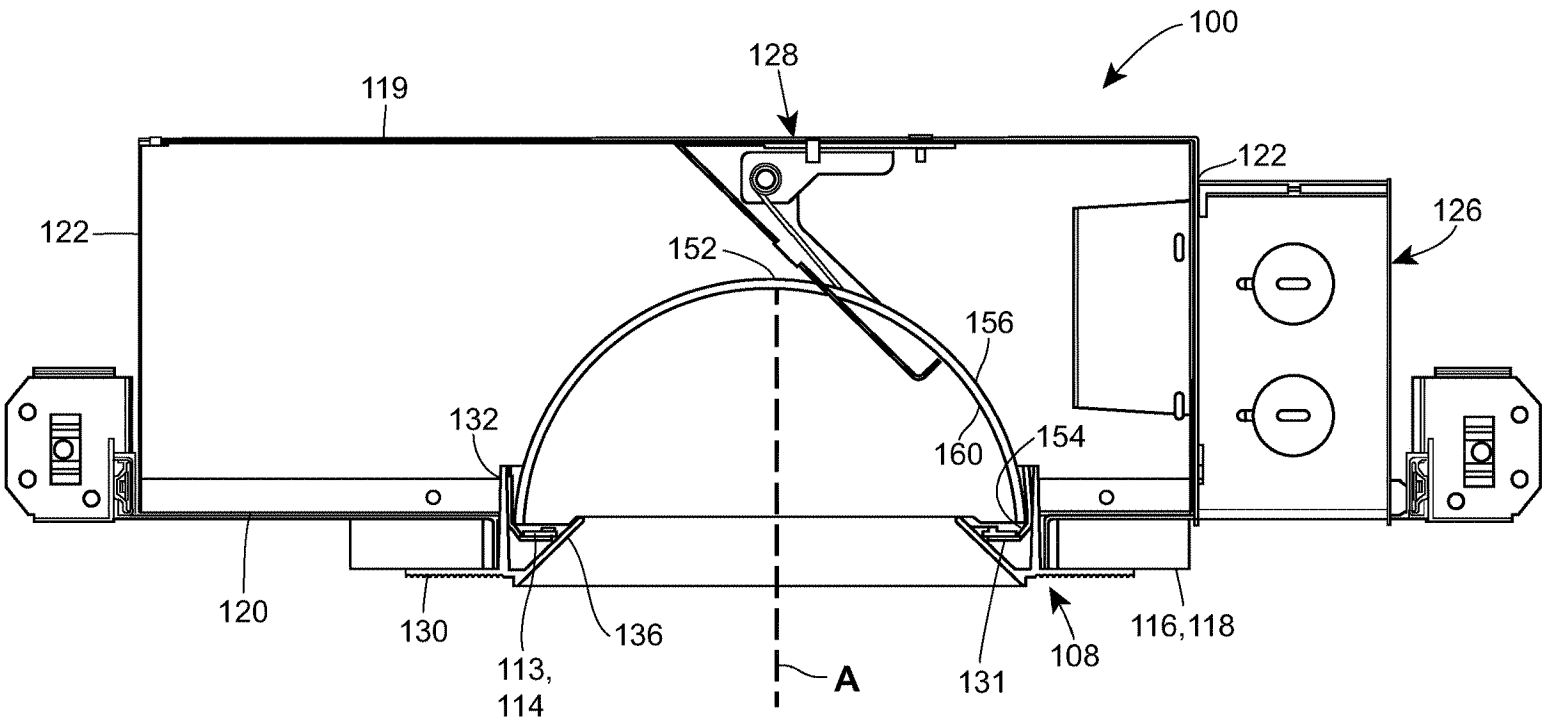
FIG. 5 is a cross-sectional view of the recessed light fixture when installed in a recessed portion of a ceiling.

The illustrated light fixture 100 includes a housing 104, a trim assembly 108 coupled to the housing 104, a reflector 112 coupled to the trim assembly 108, and an annular ring 113 coupled to the trim assembly 108 and including a plurality of light-emitting diodes (LEDs) 114. In this example, the housing 104 is depicted as being installed in a recessed portion of a ceiling 116 such that the light fixture 100 is fully recessed within the ceiling 116 and substantially flush with an exterior surface 118 of the ceiling 116, as best illustrated in FIG. 5. As a result, the light fixture 100 can be referred to herein as a flangeless light fixture. In other examples, the light fixture 100 can be installed in a recessed portion of a wall, a recessed portion of a floor, or some other architectural structure, as desired. Additionally or alternatively, the light fixture 100 can be installed such that it is only partially recessed (i.e., not fully recessed) within the ceiling or other architectural structure. In any event, when the housing 104 is so arranged in the ceiling 116, the LEDs 114 are configured to provide the above-described lighting, via the reflector 112, to the area surrounding the ceiling 116.

Figure 2:
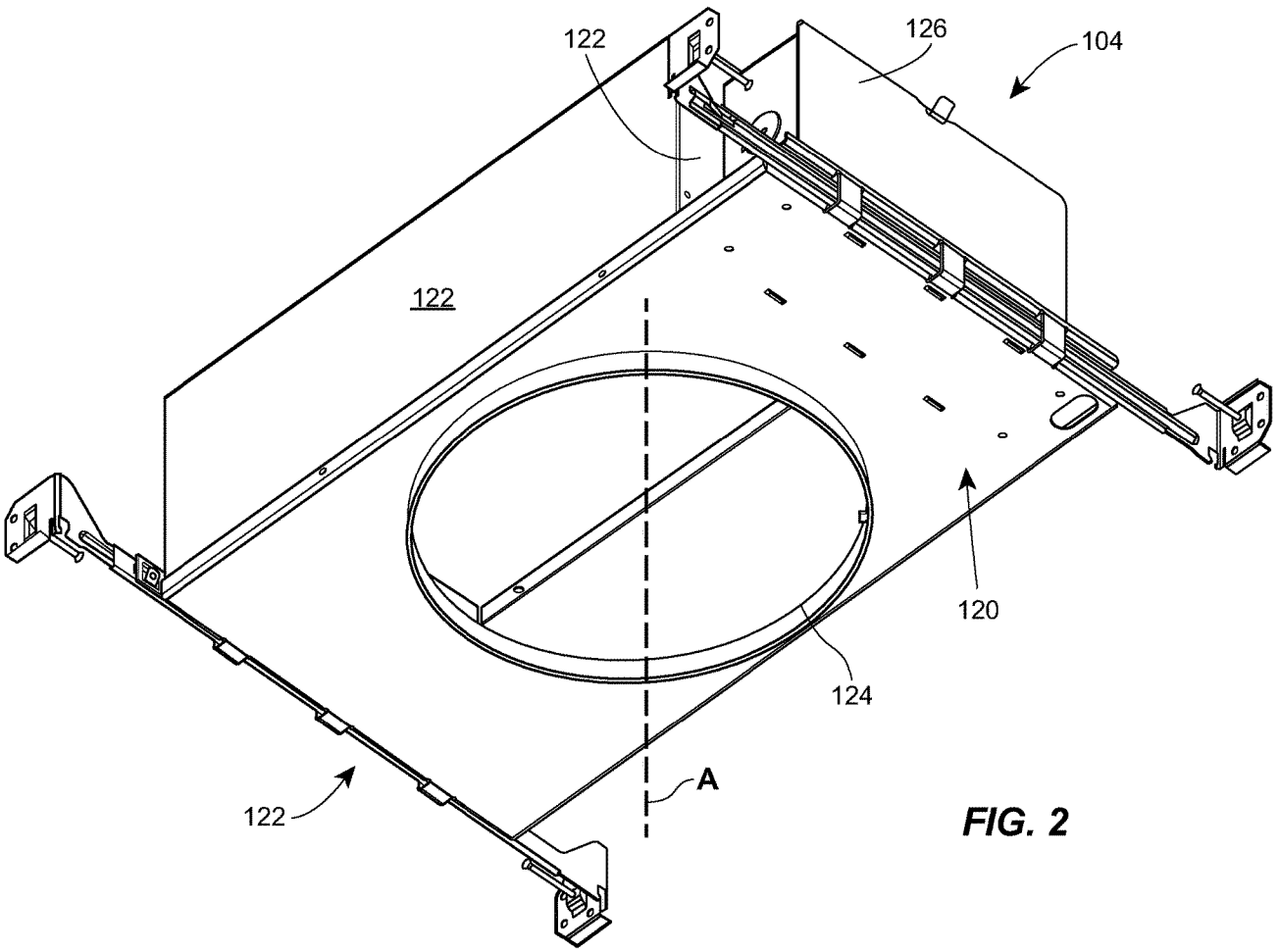
FIG. 2 is similar to FIG. 1, but shows a housing of the recessed light fixture when a trim and a reflector of the recessed light fixture are removed.

FIG. 2 illustrates the light fixture 100 with the trim assembly 108, the reflector 112, and the LEDs 114 removed from the housing 104. In this example, the housing 104 is made of a sheet metal, e.g., aluminum, steel, tin, nickel, but the housing 104 can alternatively be made of a non-sheet metal or other suitable material. As illustrated in FIG. 2 and in FIG. 5, the housing 104 is defined by a top wall 119, a bottom wall 120, and four side walls 122 extending between and connecting the top wall and the bottom wall 120. The housing 104 also includes an opening 124 formed or defined in the bottom wall 120. The opening 124 in this example has a circular shape and is centered about a longitudinal axis A. Of course, in other examples, the opening 124 can vary in shape and/or size and/or can be centered about a different axis.

With reference still to FIGS. 2 and 5, the light fixture 100 also includes a junction box 126 coupled to one of the side walls 122 of the housing 104. In other examples, the junction box 126 can be arranged differently (e.g., coupled to a different portion of the housing 104). As best illustrated in FIG. 5, the light fixture 100 also optionally includes a biasing element 128 coupled to the top wall 119 or otherwise arranged within the housing 104. The biasing element 128 is arranged to help regulate movement of the reflector 112 relative to the housing 104 so as to allow access to the junction box 126, when such access is desired, and to help properly align the reflector 112 within the housing 104 (and more particularly the opening 124). While not specifically described herein, it will also be appreciated that the light fixture 100 can include other components, such as, for example, a controller, a mounting structure for mounting the housing 104 within the ceiling 116, electric conductors, low-voltage transformers, and other components necessary for the operation of the light fixture 100.

With specific reference to FIGS. 4-7, the trim assembly 108 in this example includes an annular track member 130 and a flanged portion 131 disposed within the annular track member 130. In other examples, the trim assembly 108 may only include the annular track member 130 (i.e., no flanged portion 131), as will be described in greater detail below. In this example, the trim assembly 108 is made of a die cast aluminum, but the trim assembly 108 can alternatively be made of a different type of metal (e.g., aluminum, steel) and/or other suitable material, and/or be made in a different manner.

Figure 1:
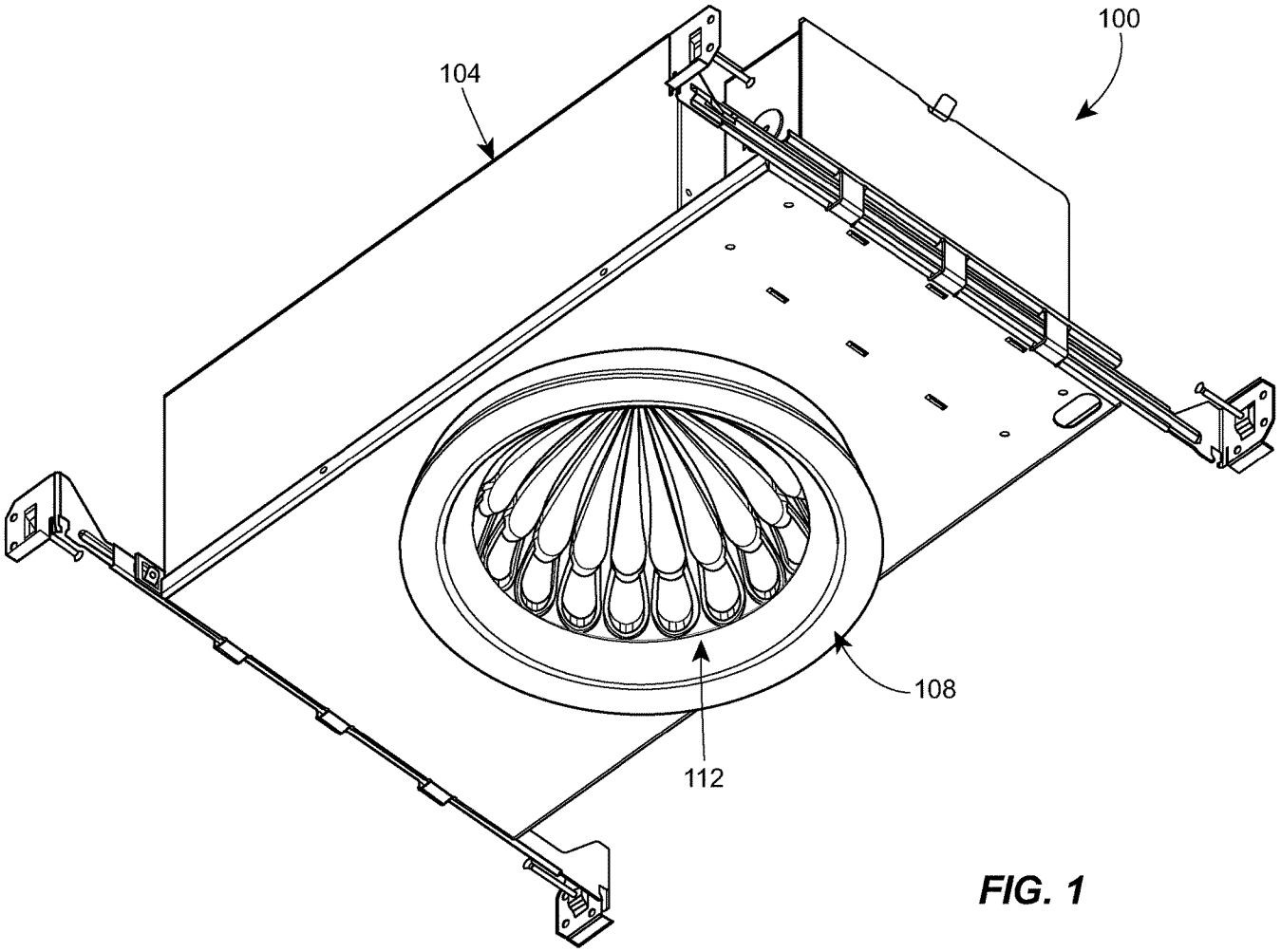
FIG. 1 is a perspective view of one example of a recessed light fixture constructed in accordance with the principles of the present disclosure.
Figure 6:
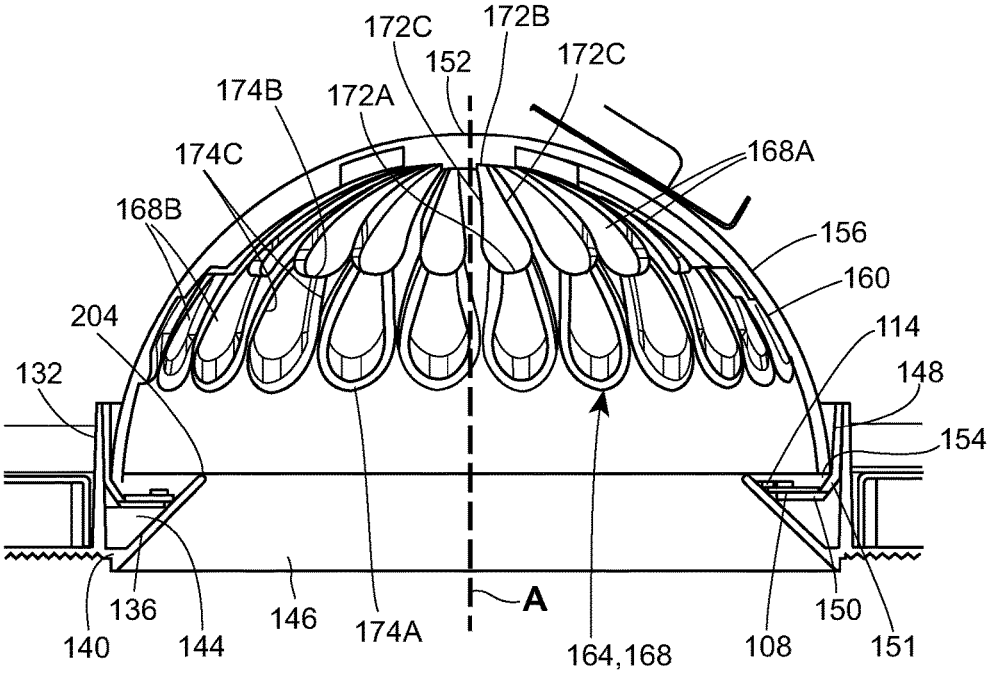
FIG. 6 is a close-up view of a first portion of FIG. 5.

As best illustrated in FIGS. 5 and 6, the annular track member 130 includes an outer wall 132, an inner wall 136 spaced radially inward of the outer wall 132, and a base surface 140 extending between and connecting the outer and inner walls 132, 136. The outer wall 132 in this example is a vertical wall that extends upward from a top of the base surface 140 in a vertical direction, such that the outer wall 132 is substantially parallel with the longitudinal axis A. In other examples, the outer wall 132 can be inclined relative to the base surface 140. The annular track member 130 is coupled to the housing 104 such that the outer wall 132 is disposed radially inward of and immediately adjacent (and in some cases in contact with) an inner surface of the housing 104 that defines the circular opening 124. As illustrated, the inner wall 136 is inclined relative to the outer wall 132 (and, thus, the longitudinal axis A). In this example, the inner wall 136 is oriented at an angle of approximately 45 degrees relative to the outer wall 132 (and approximately 45 degrees relative to the base surface 140 and the longitudinal axis A). In other examples, the inner wall 136 can be oriented at a greater or less angle relative to the outer wall 132 (and a lesser or greater angle, respectively, relative to the base surface 140). In one example, the inner wall 136 can be oriented at an angle of between approximately 20 degrees and approximately 80 degrees relative to the base surface 140. As illustrated in FIGS. 1, 5, and 6, a portion of the base surface 140 protrudes slightly outward of the housing 104, but when the light fixture 100 is installed within the ceiling 116, this portion of the base surface 140 is substantially flush with the exterior surface 118 of the ceiling 116. The annular track member 130 also includes an annular recess 144 defined between the outer and inner walls 132, 136, as well as an opening 146 that is defined by the inner wall 136 and allows indirect light to be directed or provided to the area. As illustrated, the opening 146 of the annular track member 131 has a circular shape that has a smaller diameter than the circular opening 124 of the housing 104. The circular opening 146 is substantially concentric with the circular opening 124 (both are centered about the longitudinal axis A).

Figure 7:
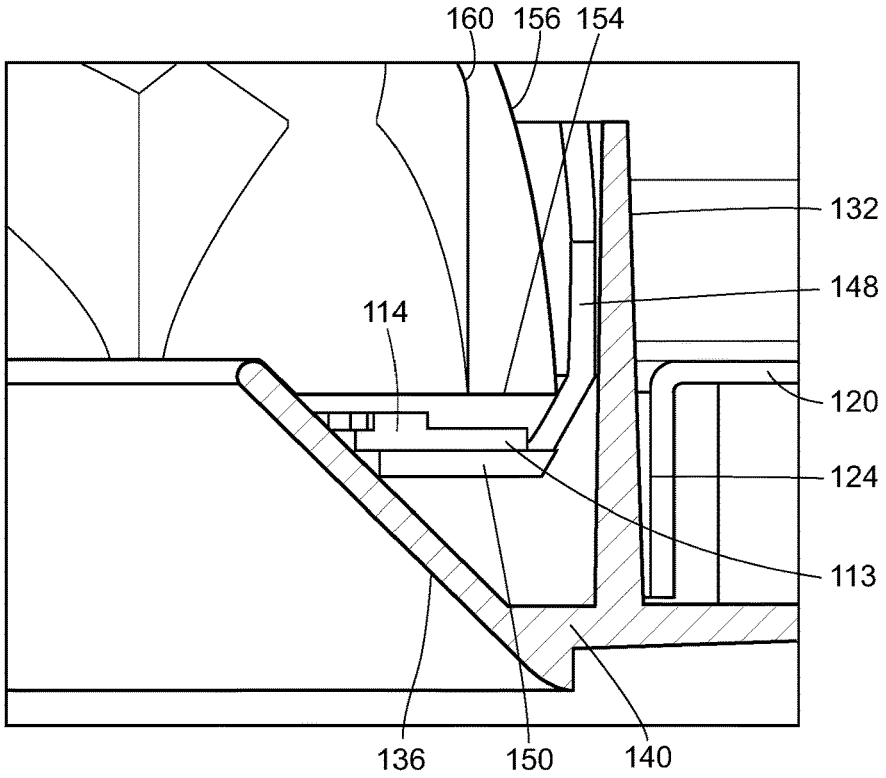
FIG. 7 is a close-up view of a second portion of FIG. 5.

As best illustrated in FIGS. 6 and 7, the flanged portion 131 includes a vertical wall 148, a horizontal wall 150, and a transition wall 151 connecting the vertical wall 148 and the horizontal wall 150. When the flanged portion 131 is disposed within the annular track member 130, at least a portion of the vertical wall 148 is disposed in the recess 144 at a position immediately adjacent (and in some cases in contact with) the outer wall 132, and the horizontal wall 150 is also disposed in the recess 144, but at a position immediately adjacent (and in some cases terminates against) the inner wall 136.

As best illustrated in FIGS. 3-7, the reflector 112 in this example is preferably injection molded and has a dome-shape defined by a crown or center 152, a perimeter portion 154, a semi-cylindrical exterior surface 156, and a semi-cylindrical interior surface 160. In other examples, the exterior surface 156 and/or the interior surface 160 can vary in shape (i.e., curvature) and or size. As an example, the exterior surface 156 and the interior surface 160 can be parabolic, hyperbolic, planar and horizontal, triangular, or take on some other shape.

When the reflector 112 is coupled to the trim 108, the center 152 of the reflector 112 is co-axially aligned with the longitudinal axis A. The exterior surface 156, which is not visible to occupants of the area when the fixture 100 is installed and operational, extends between the center 152 and the perimeter portion 154. The interior surface 160 also extends between the center 152 and the perimeter portion 154, but, unlike the exterior surface 156, the interior surface 160 is at least partially visible to occupants of the area when the fixture 100 is installed and operational. As illustrated, the perimeter portion 154 of the reflector 112 is arranged in the annular recess 144 such that the crown 152 is centrally located within the annular track member 130 and the exterior and interior surfaces 156, 160 are disposed radially inward of the outer wall 132 (with the reflector 112 spanning almost the entirety of the annular track member 130). In some cases, the perimeter portion 154 of the reflector 112 is seated against the flanged portion 131 (e.g., against the horizontal wall 150 and/or the transition wall 151). A portion of the exterior and interior surfaces 156, 160 are also arranged within the annular recess 144, but the remainder of the exterior and interior surfaces 156, 160 are arranged outside of the annular recess 144 (and more generally the annular track member 130), but within the housing 104, as illustrated in FIGS. 5 and 6.

Figure 4:
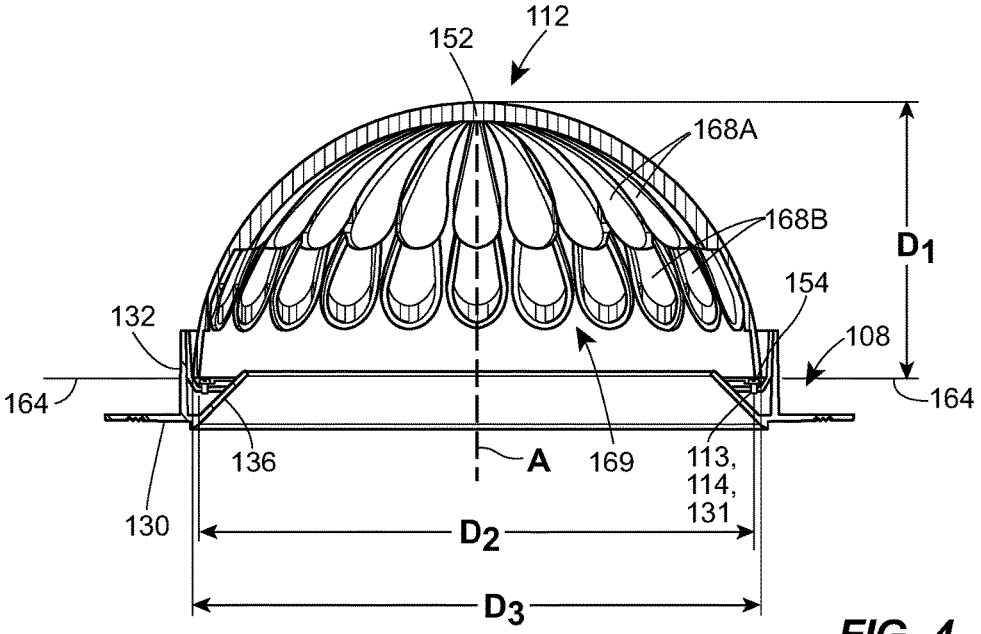
FIG. 4 is a cross-sectional view of FIG. 3.

As best illustrated in FIG. 4, the reflector 112 has a depth $D_1$ defined by a distance between the center 152 and a plane 164 extending through the perimeter portion 154 of the reflector 112. The depth $D_1$ preferably has a value that is equal to or less than 50% of an inner diameter $D_2$ of the perimeter portion 154. In one example, the depth $D_1$ is equal to 2.5 inches and the diameter $D_2$ of the perimeter portion 154 is equal to 5 inches. In another example, the depth $D_1$ is equal to 4 inches and the diameter $D_2$ of the perimeter portion 154 is equal to 8 inches. In yet another example, the depth $D_1$ is equal to 4 inches and the diameter $D_2$ of the perimeter portion 154 is equal to 12 inches. Other values are possible as well. Alternatively or additionally, the depth $D_1$ may have a value that is equal to or less than 50% of an outer diameter $D_3$ of the perimeter portion 154.

In the illustrated example, at least 50% of the interior surface 160 is reflective, such that the reflector 112 redirects light out through the opening 146 and into the area surrounding the ceiling 116. In some cases, the interior surface 160 will be entirely (100%) reflective; in other cases, however, the interior surface 160 may only be 50%, 60%, 70%, 80%, 90%, or some other percentage between 50% and 100%, reflective.

Figure 3:
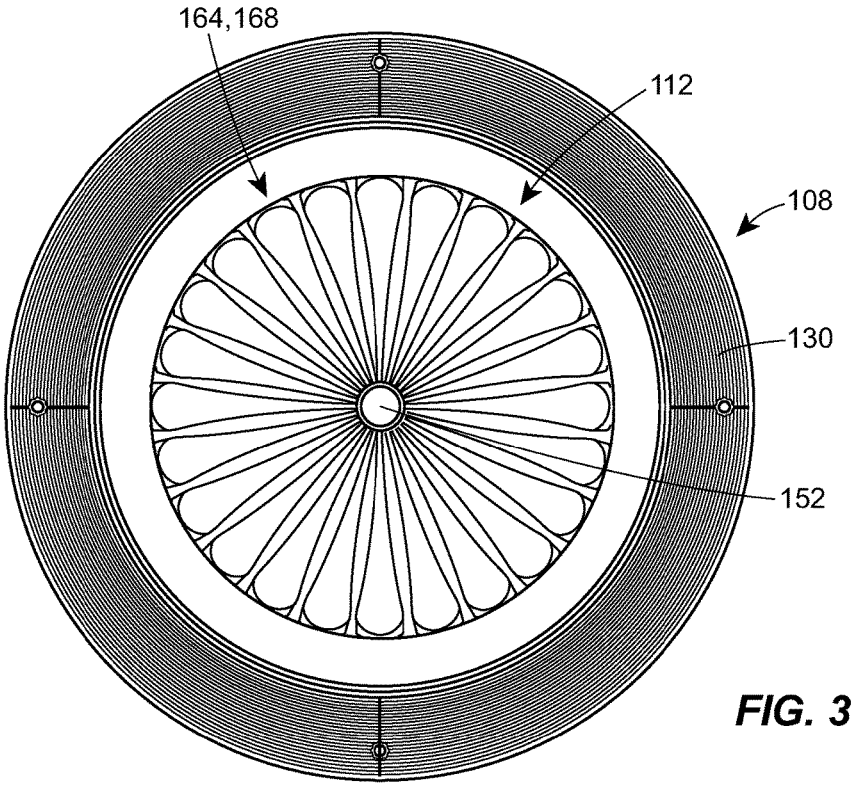
FIG. 3 is an end view of the trim and the reflector of the recessed light fixture.

As best illustrated in FIGS. 3, 4, and 6, the reflective surface 160 includes a decorative pattern 164 that enhances the aesthetic appeal of the light fixture 100. The illustrated decorative pattern 164 includes a plurality of concentrically arranged features 168. The plurality of features 168 includes a first row of features 168A and a second row of features 168B that partially overlap with the first row of features 168A.

The features 168A originate at or immediately proximate the center 152 of the reflector 112, and terminate at a position between the center 152 and the perimeter portion 154 of the reflector 112. As best illustrated in FIG. 6, each of the features 168A has a petal-like shape defined by a petal base 172A, a petal end 172B, and a pair of opposing sides 172C that extend between and connect the petal base 172A and the petal end 172B. Each petal base 172A is preferably curved such that an arc traced therethrough has a radius of curvature that is smaller than a radius of the perimeter portion 154 (the radius being equal to 50% of the diameter $D_2$). The sides 172C of each petal shaped feature 168A preferably have at least a portion that is substantially perpendicular to a plane defined by the ceiling 116 (and perpendicular to the longitudinal axis A). As an example, the sides 172C of each petal shaped feature 168A may have a portion that is exactly perpendicular to the plane or oriented at a slight angle (e.g., 5 degrees) relative to the plane defined by the ceiling. The sides 172C of each petal shaped feature 168A also converge toward one another from the base 172A to the petal end 172B, as illustrated.

The features 168B, meanwhile, originate at or immediately proximate at a petal base 172A of the features 168A, respectively, and terminate at a position between the center 152 and the perimeter portion 154 of the reflector 112 (this position being closer to the perimeter portion 154 than the position at which the features 168A terminate). Like the features 168A, each of the features 168B is shaped like a petal defined by a petal base 174A, a petal end 174B, and a pair of opposing sides 174C that extend between the petal base 174A and the petal end 174B. Each petal base 174A is preferably curved such that an arc traced therethrough has a radius of curvature that is smaller than a radius of the perimeter portion 154 (the radius being equal to 50% of the diameter $D_2$). Each petal end 174B is positioned at or immediately adjacent a respective one of the petal bases 172A. The sides 174C of each petal shaped feature 168B converge toward one another from the base 174A to the petal end 174B.

As illustrated, the features 168B are generally larger than the features 168A. More specifically, the petal bases 174A are wider than the petal bases 172A, the petal ends 174B are wider than the petal bases 172B, and the sides 174C are longer than the sides 172C. One of ordinary skill in the art will thus appreciate that the features 168 increase in size as the decorative pattern 164 extends from the center 152 toward the perimeter portion 154 of the reflector 112.

With reference now to FIGS. 5-7, the annular ring 113 is generally arranged within the annular recess 144 of the annular track member 130. The annular ring 113 is preferably arranged such that it is parallel to a plane defined by the ceiling 116 (and perpendicular to the longitudinal axis A). In some cases, such as the illustrated example, the annular ring 113 is seated on the horizontal wall 150 of the flanged portion 131, such that the annular ring 113 is indirectly coupled to the annular track member 130. In other cases, however, the annular ring 113 can be directly coupled to the annular track member 130 or indirectly coupled to the annular track member 130 in a different manner. In any event, the annular ring 113 is arranged radially inward of the perimeter portion 154 of the reflector 112 and radially outward of an innermost surface 204 of the inner wall 136. In other words, the annular ring 113 is arranged between the perimeter portion 154 and the innermost surface 204 of the inner wall 136.

As best illustrated in FIGS. 6 and 7, the plurality of LEDs 114 are arranged on the annular ring 113. The LEDs 114 are thus hidden from view by the inner wall 136 when the recessed light fixture 100 is installed in the ceiling 116. The plurality of LEDs 114 are preferably spaced an equal distance apart from one another (though they do not have to be). More preferably, the LEDs 114 are spaced a distance that is less than or equal to ⅛ of the diameter $D_2$ of the perimeter portion 154. The exact number of LEDs 114 will thus vary depending upon the spacing, but in one example, the annular ring 113 includes 72 LEDs 114, with each LED 114 spaced approximately 5 degrees apart from one another around the annular ring 113. Such an arrangement helps to provide a more uniform illumination of the patterned surface 164 when the light fixture 100 is in operation.

Figure 8:
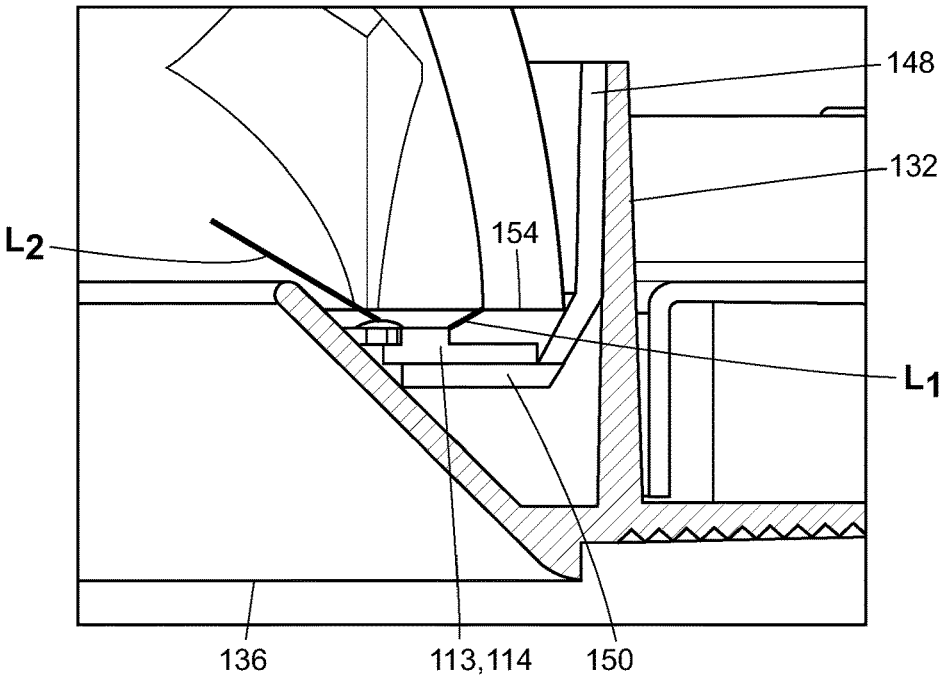
FIG. 8 is similar to FIG. 7, but shows the output of light from a plurality of light-emitting diodes of the recessed light fixture.

In operation, the LEDs 114 emit light in an upward direction, toward the reflector 112 (and away from the horizontal wall 150 of the flanged portion 132). FIG. 8 illustrates an example of how light is output from the LEDs 114. As illustrated, each LED 114 emits a first component of light $L_1$ in an upward and radially outward direction, and a second component of light $L_2$ in an upward and radially inward direction. The reflector 112, particularly the reflective surface 160, redirects the total light emitted from all of the LEDs 114 out through the opening 146 and into the area surrounding the light fixture 100. The reflector 112 thus functions to illuminate the area by providing indirect lighting, without glare, to the area, as discussed above. At the same time, the indirect lighting highlights the decorative pattern 164 of the reflector 112, and more particularly the decorative pattern 164 formed by the petal-shaped features 168, all without reducing the lighting output and efficacy of the light fixture 100.

Figure 9:
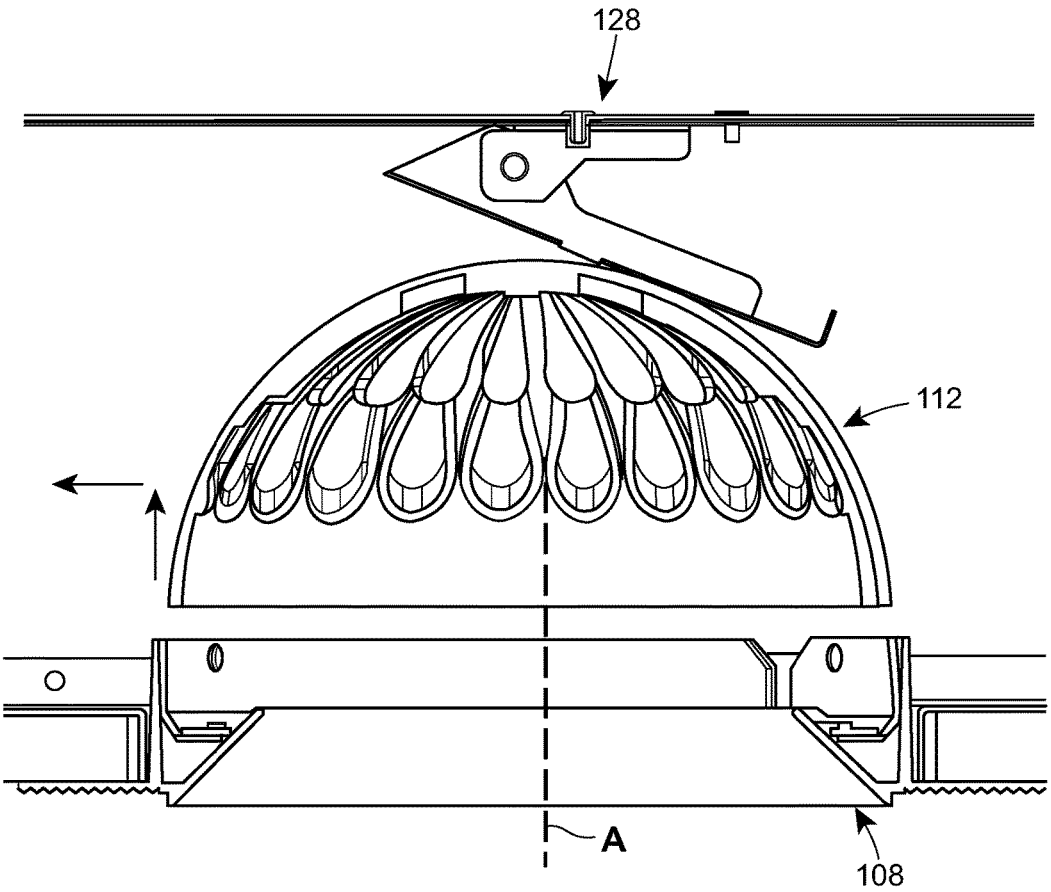
FIG. 9 is another cross-sectional view of the recessed light fixture when installed in a recessed portion of a ceiling, showing the reflector being moved in a vertical direction so as to facilitate access to a junction box of the recessed light fixture.

With reference specifically to FIG. 9, the reflector 112 is movable in a vertical direction, i.e., a direction along the central longitudinal axis A, to permit access to the junction box 126 through the opening 146, such that the light fixture 100 complies with electrical standard requirements. More particularly, the reflector 112 is movable in the vertical direction, away from the trim assembly 108 (and out of contact with the trim assembly 108) and toward the top wall 119 of the housing 104. The reflector 112 moves in this vertical direction until the reflector 112 contacts the biasing element 128 arranged in the housing 104, at which time the biasing element 128, which includes a spring that is not visible, is compressed, and the biasing element 128 automatically drives the reflector 112 outward (leftward, when viewed in FIG. 9) in a direction that is perpendicular to the central longitudinal axis A. Movement of the reflector 112 in this manner creates a pathway for a user of the light fixture 100 to access the junction box 126 through the opening 146 and the space created by the vacancy of the reflector 112 from its original position shown in FIGS. 5 and 6.

Of course, when access to the junction box 126 is no longer needed, the reflector 112 can be returned to its original position, shown in FIGS. 5 and 6, by pulling the reflector 112 back toward the trim assembly 108. While this is happening, the biasing element 128 helps to ensure that the reflector 112 is properly positioned by providing feedback that the reflector 112 has reached the proper radial position. More particularly, when the reflector 112 is moved back inward (rightward, when viewed in FIG. 9) to return the reflector 112 to its original position, the reflector 112 will contact the biasing element 128 when the reflector 112 reaches the proper radial position, thereby providing feedback that the reflector 112 can in turn be moved solely in the vertical direction back into position on the trim assembly 108.

Figure 10:
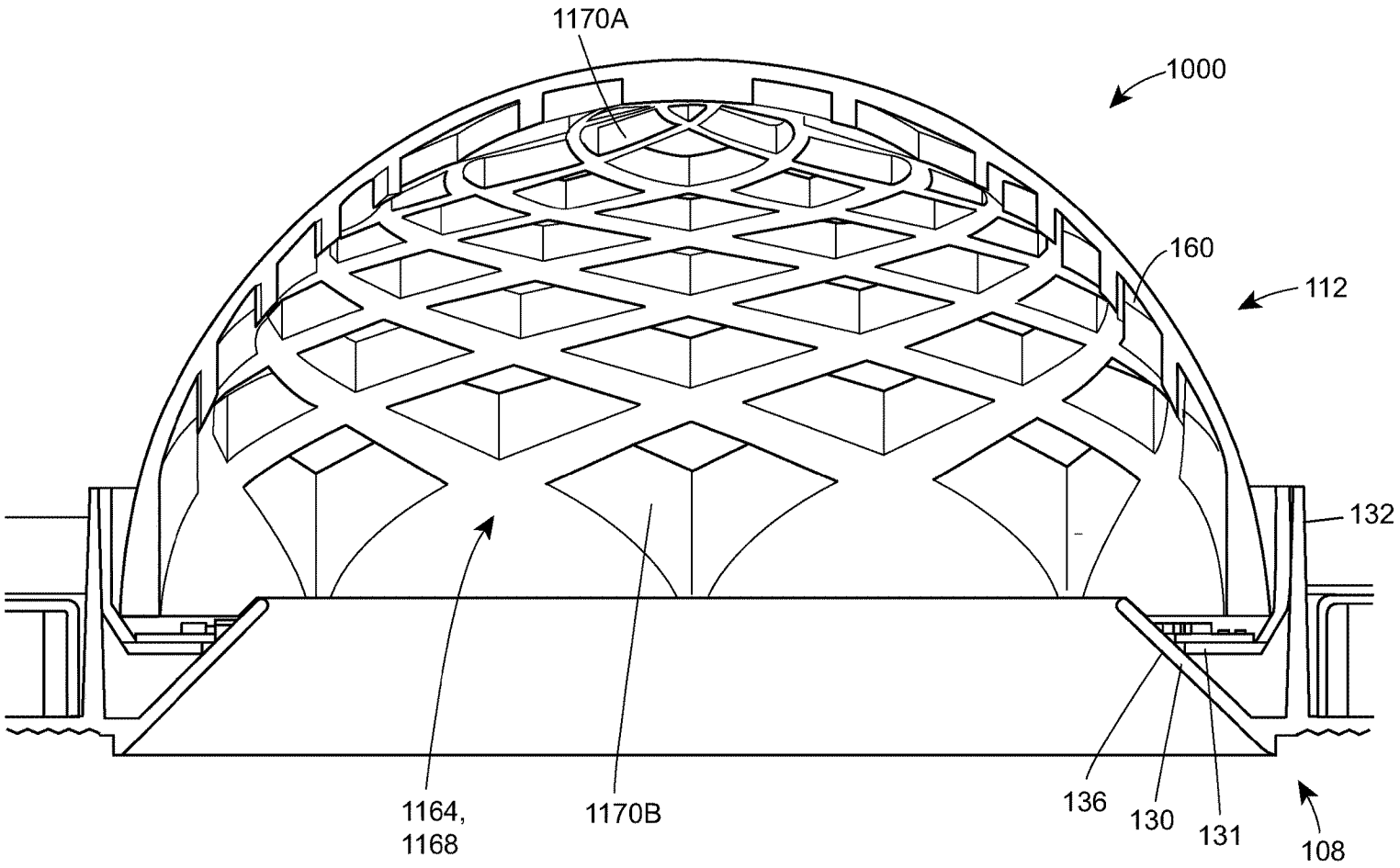
FIG. 10 is a cross-sectional view of another example of a recessed light fixture constructed in accordance with the principles of the present disclosure.

FIG. 10 depicts another example of a recessed light fixture 1000 constructed in accordance with the principles of the present disclosure. The recessed light fixture 1000 is substantially similar to the recessed light fixture 100, with similar reference numerals used to indicate similar components. However, the reflective surface 160 of the reflector 112 of the recessed light fixture 1000 includes a decorative pattern 1164 that is different from the decorative pattern 164 described above.

As illustrated in FIG. 10, the decorative pattern 1164 also includes a plurality of features 1168. The features 1168 are, like the features 168 described above, concentrically arranged in rows about the center 152 of the reflector 112. As illustrated, the spacing between adjacent rows of features 1168 varies (in this case increases) as the decorative pattern 1164 extends from the center 152 toward the perimeter portion 154 of the reflector 112. The features 1168 have a different shape than the features 168—the features 1168 have a quasi-diamond shape that varies ever so slightly (in this case, sharpens) as the decorative pattern 1164 extends from the center 152 toward the perimeter portion 154 of the reflector 112. In the illustrated example, the longitudinal extent (i.e., the height) of the projections 1168 increases as the decorative pattern 1164 moves toward the perimeter portion 154. Thus, for example, the longitudinal extent (i.e., the height) of a projection 1170A closer to the center 152 is less than the longitudinal extent (i.e., the height) of a projection 1170B positioned closer to the perimeter portion 154. In other examples, however, the shape of the projections 1168 may vary in a different manner (e.g., the longitudinal extent may decrease, a horizontal extent may increase or decrease, etc.). Each projection 1168 is preferably curved such that an arc traced through a lower edge thereof has a radius of curvature that is smaller than a radius of the perimeter portion 154 (the radius being equal to 50% of the diameter $D_2$).

Figure 11:
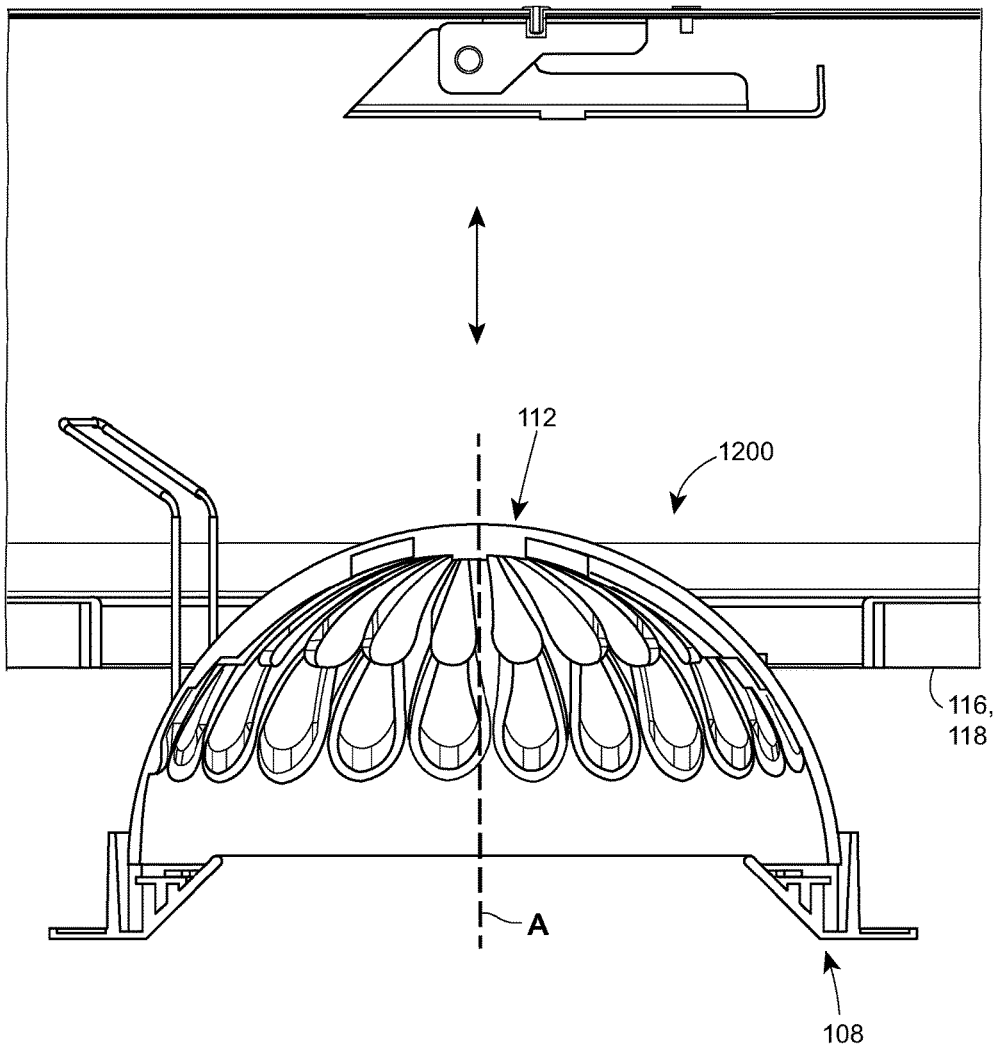
FIG. 11 is a cross-sectional view of another example of a recessed light fixture constructed in accordance with the principles of the present disclosure.

FIG. 11 depicts yet another example of a recessed light fixture 1200 constructed in accordance with the principles of the present disclosure. The light fixture 1200 is substantially similar to the recessed light fixture 100, with the exception that the light fixture 1200 is installed differently than the light fixture 1200. Unlike the light fixture 100, which is muddled to the ceiling 116 such that the light fixture 100 is fully recessed within the and substantially flush with the ceiling 116, the trim assembly 108 and the reflector 112 of the light fixture 1200 are coupled to the housing 104 of the light fixture 1200 from below, as depicted. Thus, when the trim assembly 108 and the reflector 112 of the light fixture 1200 are coupled to the housing 104, a portion of the trim assembly 108 protrudes downward, below the exterior surface 118 of the ceiling 116, such that the light fixture 1200 is not completely flush with the ceiling 116. The light fixture 1200 can thus be referred to herein as a flanged light fixture. Moreover, as a result, the reflector 112 of the light fixture 1200 is, like the reflector 112 of the light fixture 100, movable in a vertical direction, i.e., a direction along the central longitudinal axis A, to permit access to the junction box 126 through the opening 146, but the vertical direction of movement is opposite the direction of movement for the reflector 112 of the light fixture 100. As illustrated, the trim assembly 108 and the reflector 112 of the light fixture 1200 are movable in a downward direction (at least when viewed in FIG. 11) away from the trim assembly 108 (and out of contact with the trim assembly 108) and away from and out of the housing 104. Movement of the assembly 108 and the reflector 112 of the light fixture 1200 in this manner creates a pathway for a user of the light fixture 1200 to access the junction box 126 through the opening 146.

While the invention has been described in connection with various embodiments, it will be understood that the invention is capable of further modifications. This application is intended to cover any variations, uses or adaptations of the invention following, in general, the principles of the invention, and including such departures from the present disclosure as, within the known and customary practice within the art to which the invention pertains.

The invention claimed is:

1. A recessed light fixture configured to deliver indirect light to an area, the recessed light fixture comprising:

a trim component having an outer wall and an inner wall spaced radially inward of the outer wall, the trim component defining an annular recess between the outer and inner walls;

a curved reflector coupled to the trim component, the reflector comprising a patterned reflective surface; and an annular ring arranged within the annular recess of the trim component, the annular ring comprising a plurality of light-emitting diodes (LEDs), wherein the LEDs are configured to emit light toward the reflector so that the reflector redirects the light to deliver the indirect light to the area, and wherein the trim component further comprises a base surface coupled to and connecting the outer and inner walls, wherein the inner wall is oriented at an angle of between approximately 20 degrees and approximately 80 degrees relative to the base surface.

2. The recessed light fixture of claim 1, wherein the reflector has a depth defined by a distance between a center of the reflector and a plane extending through a perimeter portion of the reflector, and wherein the depth is equal to or less than 50% of a diameter of the perimeter portion of the reflector.

3. The recessed light fixture of claim 1, wherein the inner wall is angled relative to the outer wall.

4. The recessed light fixture of claim 1, wherein the plurality of LEDs are circumferentially arranged around the annular ring, the plurality of LEDs being spaced an equal distance apart from one another.

5. The recessed light fixture of claim 4, wherein the plurality of LEDs are spaced a distance that is less than ⅛ of a diameter of the reflector.

6. The recessed light fixture of claim 1, wherein the reflector comprises an exterior surface and an interior surface, the interior surface comprising the patterned reflective surface, and the patterned reflective surface forming at least 50% of the interior surface.

7. The recessed light fixture of claim 1, further comprising a housing, the trim component coupled to the housing and the reflector disposed in the housing.

8. The recessed light fixture of claim 7, further comprising a junction box coupled to the housing, wherein the reflector is movable in a vertical direction to permit access to the junction box.

9. The recessed light fixture of claim 8, wherein the reflector is further movable in a horizontal direction, perpendicular to the vertical direction.

10. The recessed light fixture of claim 8, further comprising a biasing element arranged to control movement of the dome-shaped reflector.

11. A recessed light fixture configured to deliver indirect light to an area, the recessed light fixture comprising:

a trim component having an outer wall and an inner wall spaced radially inward of the outer wall, the trim component defining an annular recess between the outer and inner walls;

a dome-shaped reflector coupled to the trim component, the dome-shaped reflector comprising a patterned reflective surface, wherein the patterned reflective surface comprises a plurality of decorative features concentrically arranged in rows; and an annular ring arranged within the annular recess of the trim component, the annular ring comprising a plurality of light-emitting diodes (LEDs), wherein the LEDs are configured to emit light toward the reflector so that the reflector redirects the light to deliver the indirect light to the area, and wherein a spacing between adjacent rows of decorative features varies as the patterned reflective surface extends from a center of the dome-shaped reflector to a perimeter portion of the dome-shaped reflector.

12. The recessed light fixture of claim 11, wherein the decorative features each comprise one or more side walls, and wherein at least a portion of each of the one or more side walls is oriented substantially parallel to a longitudinal axis.

13. A recessed light fixture configured to deliver indirect light to an area, the recessed light fixture comprising:

a trim assembly comprising an annular track member and a flanged portion, the annular track member having an outer wall and an inner wall spaced radially inward of the outer wall, the annular track member defining an annular recess between the outer and inner walls, and the flanged portion at least partially disposed in the annular recess;

a reflector coupled to the trim assembly, the reflector comprising a patterned reflective surface; and an annular ring seated on the flanged portion within the annular recess of the annular track member, the annular ring comprising a plurality of light-emitting diodes (LEDs), wherein the LEDs are configured to emit light toward the reflector so that the reflector redirects the light to deliver the indirect light to the area.

14. The recessed light fixture of claim 13, wherein the reflector has a depth defined by a distance between a center of the reflector and a plane extending through a perimeter portion of the reflector, and wherein the depth is equal to or less than 50% of a diameter of the perimeter portion of the reflector.

15. The recessed light fixture of claim 13, wherein the plurality of LEDs are circumferentially arranged around the annular ring, the plurality of LEDs being spaced an equal distance apart from one another.

16. The recessed light fixture of claim 13, further comprising a housing and a junction box coupled to the housing, the trim assembly coupled to the housing and the reflector disposed in the housing, wherein the reflector is movable, relative to the housing, in a vertical direction to permit access to the junction box.

* * * * *